US009879432B2

(12) United States Patent
Oliver et al.

(10) Patent No.: US 9,879,432 B2
(45) Date of Patent: Jan. 30, 2018

(54) OUTDOOR WALL PADDING APPARATUS AND METHODS FOR FORMING AND USING THE SAME

(71) Applicant: Sportsfield Intellectual, LLC, Delhi, NY (US)

(72) Inventors: Wayne P. Oliver, Delhi, NY (US); Matthew L. Cross, Salisbury, NC (US); Joshua A. Hicks, Sherburne, NY (US)

(73) Assignee: Sportsfield Intellectual, LLC, Delhi, NY (US)

( * ) Notice: Subject to any disclaimer, the term of this patent is extended or adjusted under 35 U.S.C. 154(b) by 0 days.

(21) Appl. No.: 14/830,263

(22) Filed: Aug. 19, 2015

(65) Prior Publication Data

US 2017/0051511 A1 Feb. 23, 2017

(51) Int. Cl.
*E04F 13/072* (2006.01)
*E04H 3/14* (2006.01)

(52) U.S. Cl.
CPC ..... *E04F 13/072* (2013.01); *E04H 3/14* (2013.01)

(58) Field of Classification Search
CPC ... E04F 13/072; E04F 13/075; E04F 13/0875; E04H 3/14
See application file for complete search history.

(56) References Cited

U.S. PATENT DOCUMENTS 2,606,755 A * 8/1952 Samuels ..... E04H 3/14 114/219
3,027,967 A 4/1962 Silver
3,965,507 A 6/1976 Reiland
4,057,245 A 11/1977 Gordon
4,215,857 A * 8/1980 Gordon ..... A63B 6/02 482/15
5,280,689 A * 1/1994 Mill ..... E04B 2/92 52/169.14
5,713,696 A * 2/1998 Horvath ..... E02D 31/02 264/321
7,244,477 B2 7/2007 Sawyer et al.
7,575,795 B2 8/2009 Scott et al.
7,575,796 B2 8/2009 Scott et al.
7,662,468 B2 2/2010 Bainbridge
7,753,826 B1 * 7/2010 Oliver ..... A63B 6/02 482/23
8,082,696 B2 * 12/2011 Oliver ..... B32B 3/04 267/142
8,241,726 B2 8/2012 Scott et al.
8,424,249 B2 4/2013 Oliver
(Continued)

OTHER PUBLICATIONS

Oliver, U.S. Appl. No. 14/250,585, entitled "Reversible Resilient Wall Padding Apparatus and Methods for Releasably Attaching Same to a Wall", filed Apr. 11, 2014.

*Primary Examiner* — Adriana Figueroa
(74) *Attorney, Agent, or Firm* — Heslin Rothenberg Farley and Mesiti PC

(57) ABSTRACT

An outdoor wall padding apparatus attachable to a vertical structure includes an upper padding section, and a lower drainage section disposed below the upper padding section. The outdoor wall padding apparatus is attachable to the vertical structure with the lower drainage section positionable adjacent to the ground and operable to allow water to pass into and out of the lower drainage section.

23 Claims, 10 Drawing Sheets

(56) References Cited

U.S. PATENT DOCUMENTS

| | | | |
|---|---|---|---|
| 8,990,987 | B2 | 3/2015 | Wyman et al. |
| 2007/0092694 | A1 | 4/2007 | Scott et al. |
| 2014/0182049 | A1 | 7/2014 | Prust et al. |

* cited by examiner

OUTDOOR WALL PADDING APPARATUS AND METHODS FOR FORMING AND USING THE SAME

FIELD OF THE DISCLOSURE

The present disclosure relates generally to outdoor wall padding, and more particularly to outdoor wall padding apparatus having integrated drainage and methods for forming and using the same.

BACKGROUND

Outdoor stadium wall padding has been a fixture since the 1970's, protecting athletes at all levels from dangerous impacts with solid wood and/or concrete walls. The wall padding is typically constructed of three materials, a ¾ inch plywood backer board, a 3 inch polyurethane foam padding adhered to the board, and a laminated or coated UV resistant vinyl cover. This construction provides an appropriate level of safety and durability while addressing the aesthetics required by both college and professional teams. In use, the outdoor wall padding is disposed with the bottom of the wall padding spaced typically about 4 inched from the ground.

In connection with outdoor wall padding, U.S. Pat. No. 8,082,696 issued to Oliver et al., and U.S. Pat. No. 8,424,249 issued to Oliver, disclose temperature compensating outdoor wall padding apparatus, which in one embodiment includes a rigid backing, padded material, and incorporates a stretch fabric into the edges of a vinyl cover to provide a tension on the vinyl cover minimizing the possibility of wrinkling of the vinyl cover due to a change in temperature. In another embodiment, the temperature compensating outdoor wall padding apparatus employs a rigid backing, padded material, and a resilient cover. The resilient cover is stretchable in 4 directions and pre-tensioned to provide tension on the resilient cover minimizing the possibility of wrinkling of the resilient cover due to a change in temperature. Z-shaped clips are attached to and extend horizontally across rear side of the backing and cooperate with corresponding horizontally disposed Z-shaped clips attached to a fence or wall of a stadium for supporting the temperature compensating outdoor wall padding apparatus.

In connection with pit landing systems, U.S. Pat. No. 7,753,826 issued to Oliver et al. discloses a pit landing system for high jumps and pole vaults. The pit landing system includes integrated drainage positionable on a surface of a ground and includes an upper padding section and a lower support section. The lower support section includes a lower water permeable support operable to allow water to permeate through its structure while supporting the padding layer above the surface of the ground. The upper padding section includes a cover and the lower support section comprises a porous cover. For satisfying the National High School Federation (NFHS), the National Collegiate Athletic Association (NCAA), and the International Association of Athletics Federations (IAAF) specifications and/or requirements, for example, the overall size of a high jump pit pad landing system may be about 16½ feet wide, about 8 feet deep, and about 26 inches high, or about 20 feet wide, about 13 feet deep, and about 28 inches high. For satisfying the National High School Federation (NFHS), the National Collegiate Athletic Association (NCAA), and the International Association of Athletics Federations (IAAF) specifications and/or requirements, for example, the overall size of a pole vault pit pad landing system may be about 21½ feet wide, about 27 feet deep, and about 32 inches high.

There is a need for further outdoor wall padding, and more particularly to outdoor wall padding apparatus having integrated drainage and methods for forming and using the same.

SUMMARY

In a first aspect, the present disclosure provides an outdoor wall padding apparatus attachable to a vertical structure, in which the outdoor wall padding apparatus includes an upper padding section, a lower drainage section disposed below the upper padding section, and wherein the outdoor wall padding apparatus is attachable to the vertical structure with the lower drainage section positionable adjacent to the ground and operable to allow water to pass into and out of the lower drainage section.

In a second aspect, the present disclosure provides an outdoor wall padding system, which includes a plurality of outdoor wall padding apparatus having a lower integrated drainage section, and the plurality of outdoor wall padding apparatus being operably attached to the vertical structure disposed around at least a portion of a field.

In a third aspect, the present disclosure provides a method for use in protecting athletes on an outdoor field. The method includes providing a plurality of outdoor wall padding apparatus having a lower integrated drainage section disposed side-by-side around at least a portion of the outdoor field.

In a fourth aspect, the present disclosure provides a method for use in maintaining a sports ball on a field. The method includes providing a plurality of outdoor wall padding apparatus having a lower integrated drainage section disposed side-by-side along at least a portion of the field with a bottom of the lower drainage section disposed adjacent to the ground so that the sports ball is prevented from passing underneath the lower drainage section of the plurality of outdoor wall padding apparatus.

In a fifth aspect, the present disclosure provides a method for forming an outdoor wall padding apparatus having integrated drainage. The method includes providing an upper padding member, providing a lower water permeable member disposed below the upper padding member, and wherein the lower permeable member is operable to allow water to pass into and out of the lower permeable member.

In a sixth aspect, the present disclosure provides a method for forming an outdoor wall padding apparatus having integrated drainage. The method includes providing a generally rigid backing, providing a padded member disposed over the backing, providing a water permeable member below the padded member in which the water permeable member being operable to allow water to pass into and out of the water permeable member, and providing a cover disposed over the padded member and water permeable member wherein at least a portion of the cover disposed over the water permeable member is porous.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

Figure 1:
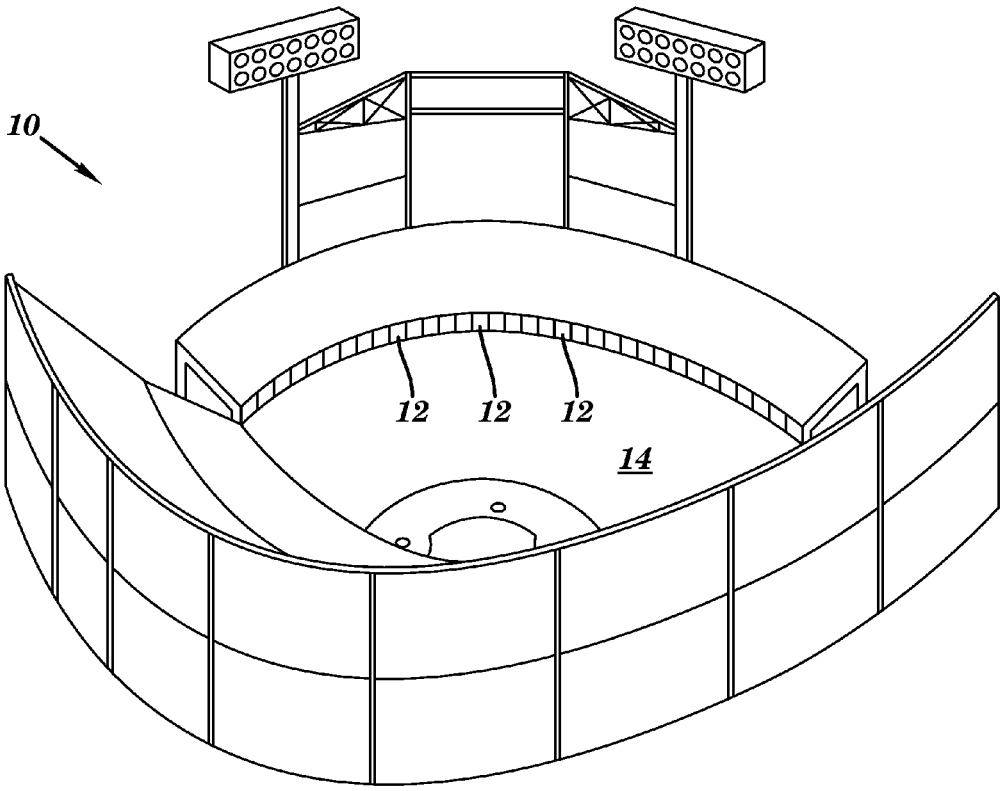
FIG. 1 is a perspective view of an outdoor field or stadium having a plurality of outdoor wall padding apparatus having integrated drainage in accordance with aspects of the present disclosure.
Figure 2:
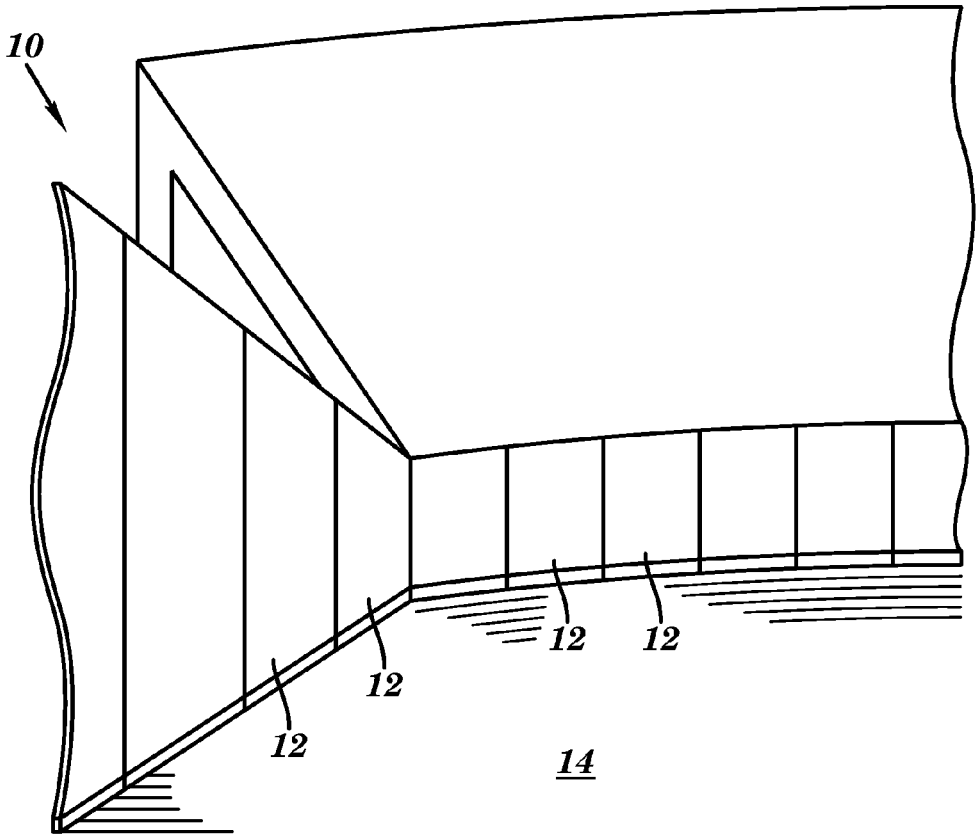
FIG. 2 is an enlarged perspective view of some of the plurality of outdoor wall padding apparatus having integrated drainage of FIG. 1.

FIGS. 1 and 2 illustrate one embodiment of an exemplary outdoor field or stadium 10 having a plurality of outdoor wall padding apparatus 12 having integrated drainage disposed side-by-side along a portion of the field such as one or more walls of the field or stadium in accordance with aspects of the present disclosure. As best seen in FIG. 2, bottom portions of the plurality of outdoor wall padding apparatus 12 having integrated drainage may be disposed adjacent to the surface of the ground 14.

The outdoor wall padding apparatus of the present disclosure may be installed so as to reduce the gap between the bottom of the outdoor wall padding apparatus and the ground compared to the installation of conventional outdoor wall padding in which the bottom of the wall padding is spaced apart about 4 inches from and above the ground. The outdoor wall padding apparatus may be adjacent to the ground such as suspended just above the ground or rested on the ground. The outdoor wall padding apparatus may maintain a sports ball such as a baseball, a softball, a lacrosse ball, a field hockey ball, a tennis ball, or the like on a field. For example, the present disclosure may reduce the likelihood during a game of baseball or softball of losing live baseballs or softballs under the pad requiring, for example, having outfielders actually search for the missing balls. In addition, the present disclosure solves the problem of degradation of conventional wall padding if positioned to rest adjacent to the ground and be left to sit in wet or muddy environments which would otherwise result in premature failure of the foam, the vinyl, and/or the wood backing of a conventional wall padding.

As described in greater detail below, a drainage system is built into the bottom of an outdoor wall padding apparatus. For example, in one embodiment, the outdoor wall padding apparatus may include an upper padding section and the addition of a lower synthetic drainage portion held in place by a mesh fiber system.

Figure 3:
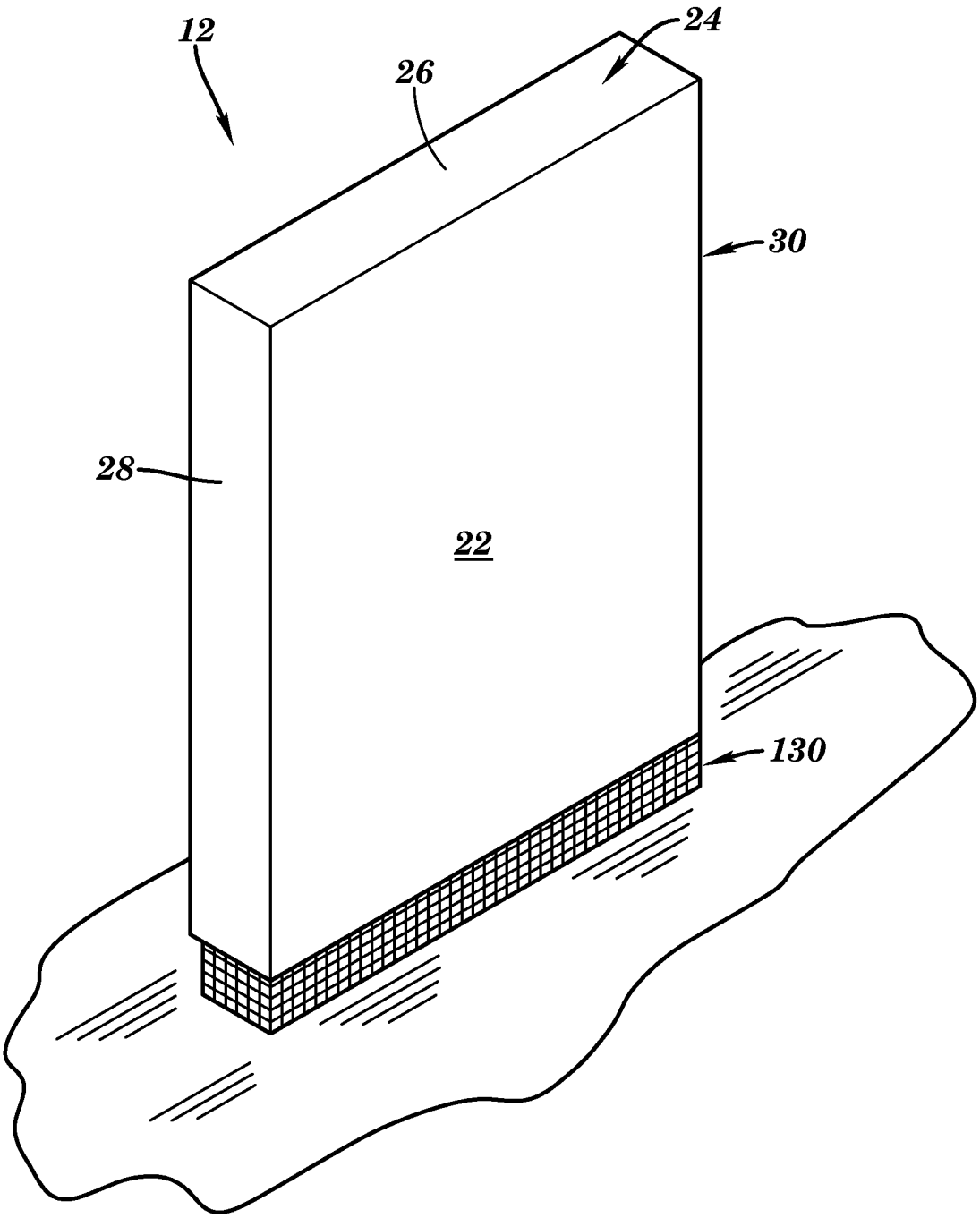
FIG. 3 is an enlarged perspective view of one of the plurality of outdoor wall padding apparatus having integrated drainage of FIGS. 1 and 2.

With reference to FIG. 3, outdoor wall padding apparatus 12 may generally include a main front surface or side 22, a main rear surface or side (not shown in FIG. 3), and a peripherally-extending surface or side 24 disposed between main front side 22 and the main rear side. Peripherally-extending side 24 may include a horizontal top side 26, a horizontal bottom side (not shown in FIG. 3), a vertical right side 28, and a vertical left side (not shown in FIG. 3). Outdoor wall padding apparatus 12 may further include an upper padding section 30 and a lower drainage section 130. In this illustrated embodiment, the outdoor wall padding apparatus may be generally rectangular such as in the form of a cuboid or rectangular prism. The front side and the rear side may be generally evenly spaced apart so that the outdoor wall padding apparatus has a generally constant thickness. It will be appreciated that other suitable configurations or shapes may be employed for the outdoor wall padding apparatus.

Figure 4:
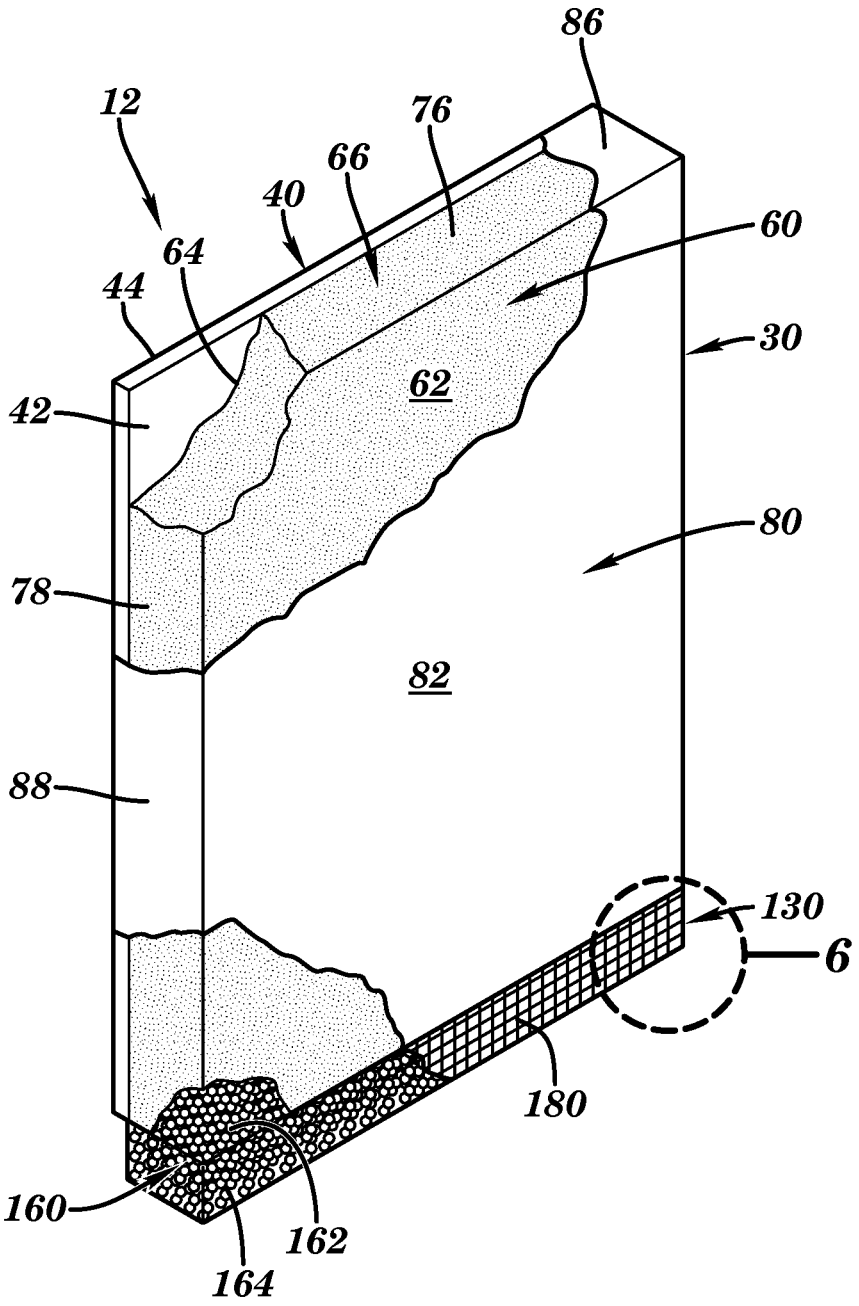
FIG. 4 is a perspective view, partially cutaway, of the outdoor wall padding apparatus having integrated drainage of FIG. 3.

As best shown in FIG. 4, upper padding section 30 of outdoor wall padding apparatus 12 may generally include a generally rigid backing 40, a padded member 60, and a cover 80. Lower drainage section 130 of outdoor wall padding apparatus 12 may include a water permeable member 160 and a porous cover 180.

Generally rigid backing 40 includes a front side 42 and a rear side 44. The backing may be fabricated from plywood, a thermoplastic material, a biocomposite material, or other suitable generally rigid board material. The generally rigid backing may be about ¾ inch thick. It will be appreciated that other generally rigid backing materials may be suitably configured such as a wood, plastic, or metal frame or other structure.

Padded member 60 may be formed from polyurethane such as expanded polypropylene (EPP), expanded polyethylene (EPE), fused beaded EPE foam, or other foam or resilient material for providing protection to an athlete upon contact with the outdoor wall padding apparatus. Padded member 60 may include a front side 62, a rear side 64, and a peripherally-extending edge 66. Peripherally-extending edge 66 may include a horizontal top edge 76, a horizontal bottom edge (not shown in FIG. 4), a vertical right side edge 78, and a vertical left side edge (not shown in FIG. 4). The rear side of the padded member may be disposed over the front side of the generally rigid backing. For example, a water-based adhesive may be used to attach the padded member to the generally rigid backing. The padded member may be about 3 inches in thickness and correspond to the width and height of the generally rigid backing.

Figure 5:
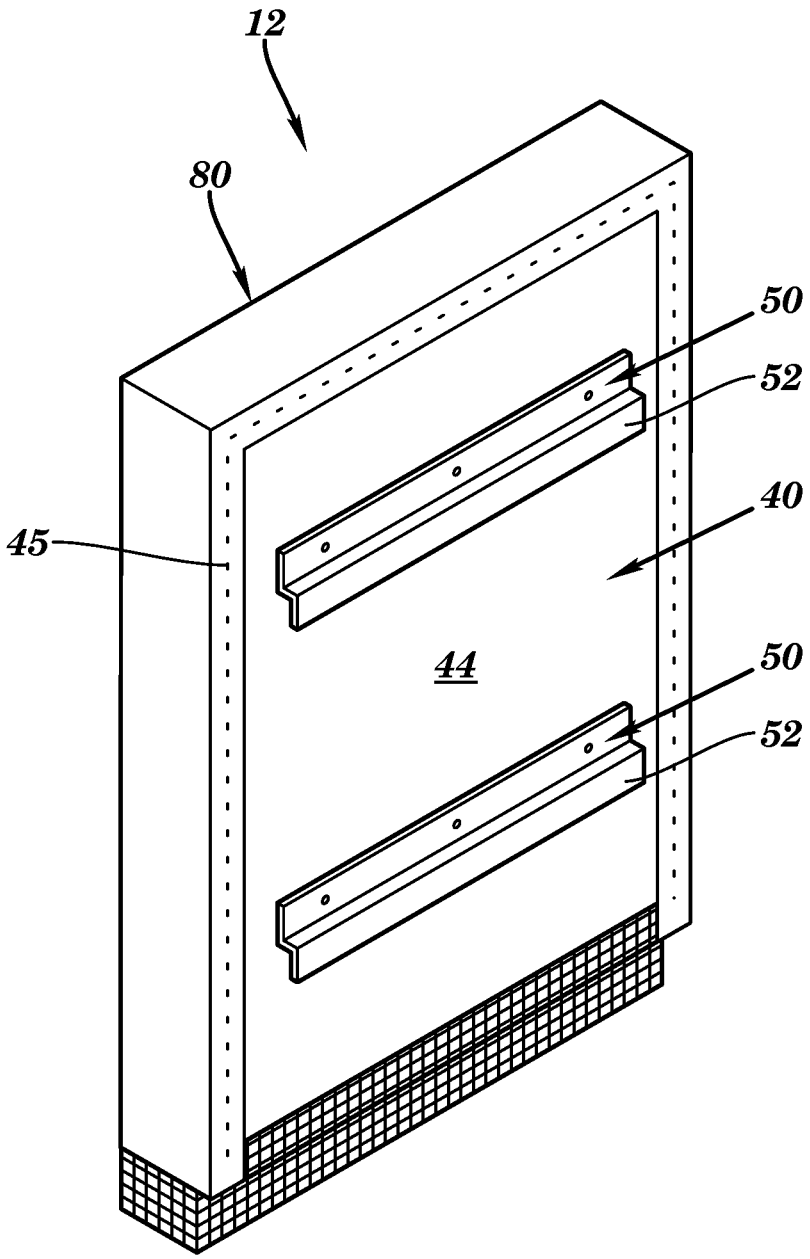
FIG. 5 is a rear perspective view of the outdoor wall padding apparatus having integrated drainage of FIG. 3.

Cover 80 may cover and extend over front side 62 and around portions of the thickness of padded member 60, i.e., extend along portions of the peripherally-extending edge of the apparatus. For example, cover 80 may be a vinyl cover such as a high ultraviolet (UV) 16 ounce or 25 ounce laminated or coated vinyl. Cover 80 includes a central portion 82 extending over the front side of the padded member and a peripherally-extending portion defining a horizontal top portion 86, a vertical right side portion 88, and a vertical left side portion (not shown in FIG. 4) disposed over peripherally-extending horizontal top edge 76, the vertical right side edge 78, and the vertical left side edge, respectively, of the padded member. As shown in FIG. 5, the edges of cover 80 may be secured to rear 44 surface of backing 40 with galvanized or stainless steel staples 45, nails, or other suitable attachment means.

With reference again to FIG. 4, lower drainage section 130 of outdoor wall padding apparatus 12 may include water permeable member 160 and porous cover 180. Lower drainage section 130 is disposed below upper padding section 30. Water permeable member 160 may include an upper surface 162, peripherally-extending side surface 164, and a bottom surface (not shown in FIG. 4). For example, peripherally-extending side surface 164 may include a vertical front side surface, a vertical rear side surface, and vertical right and left side surfaces. As described in greater detail below, the material forming the lower support may be operable to allow water to permeate through its structure.

Porous cover 180 may cover the peripherally-extending side surface and the bottom surface of water permeable member 160. For example, the lower cover may extend across the entire bottom surface of the lower support. Porous cover 180 may be formed from a vinyl mesh material. For example, porous cover 180 may be formed from a 10 oz. woven vinyl coated polyester mesh manufactured and available from BondCote Corporation of Pulaski, Va., and identified as TurMesh #C10655 11×11. It will be appreciated that other suitable porous materials and non-porous materials may be suitably employed for the cover materials.

Padded member 60 and water permeable member 160 may be suitably attached together. For example, upper surface 162 of water permeable member 160 may be operably attached to a lower surface of padded member 60 using an adhesive or other bonding material such an adhesive manufactured and available from Slocum Adhesives Corporation of Lynchburg, Va., product number S-5267. It will be appreciated that other suitable attachment means may be employed for attaching padded member 60 and water permeable member 160. It will be appreciated that the padded member and the water permeable member need not be attached or bonded together.

Figure 6:
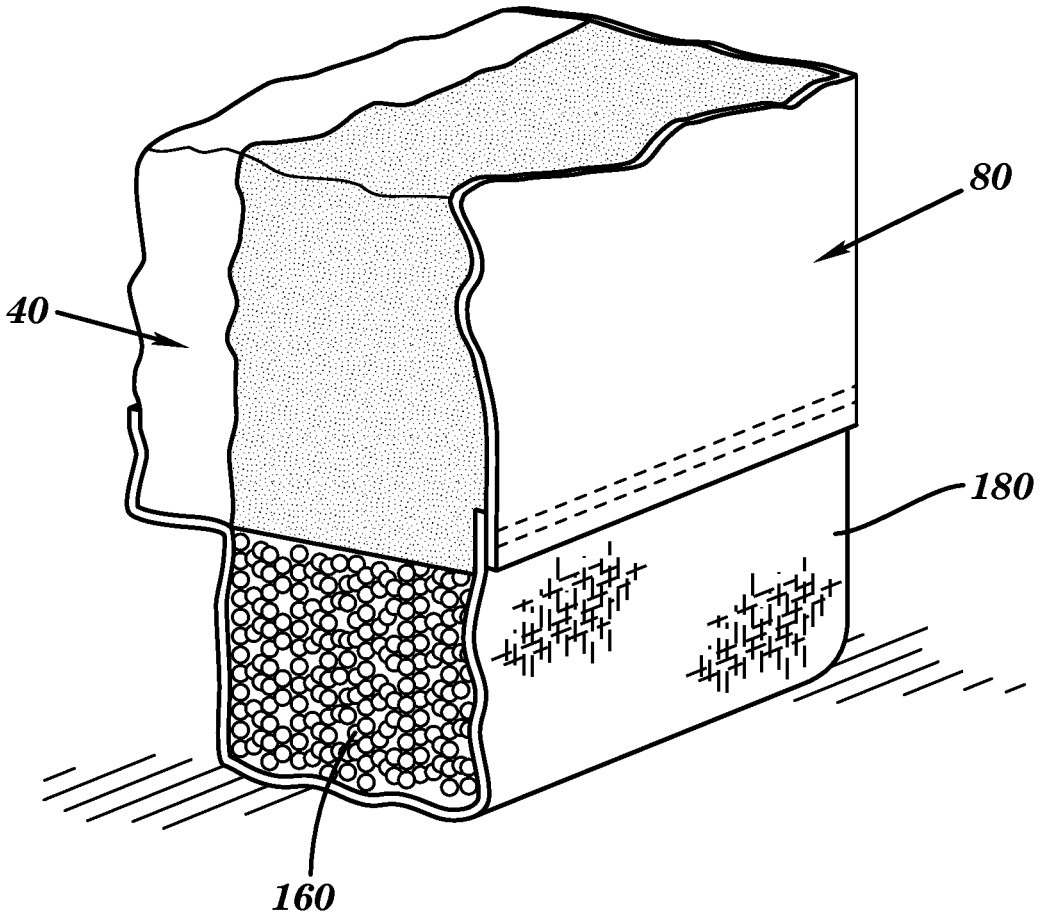
FIG. 6 is an enlarged perspective view, partially cutaway, of detail 6 in FIG. 4.

As shown in FIG. 6, abutting edge portions of upper cover 80 and lower cover 180 may be attached together with, e.g., double stitched seams. In another embodiment, hook-and-loop fasteners such as VELCRO fasteners may be used to attach the edge portions of an upper cover and a lower cover together. For example, a 2 inch, a 4 inch, a 6 inch, an 8 inch, or other suitable size wide strip of VELCRO fasteners may be disposed between the upper section and the lower section.

With reference again to FIGS. 3 and 4, it will be noted that upper padded section 30 and lower drainage section 130 may define outdoor wall padding apparatus 12 having a vertical planar front surface side that faces the playing field and extends from the ground upwardly. With reference to FIGS. 4 and 6, water permeable member 160 may be not extend below backing 40, e.g., backing 40 may be spaced above the ground.

As noted above and with reference again to FIG. 4, the lower drainage section integrates a drainage layer into the lower portion of the outdoor wall padding apparatus. The end result is a product which allows both water and air to freely move through the lower section of the outdoor wall padding apparatus, minimizing the potential for premature failure of the outdoor wall padding apparatus. The lower drainage section is sized and configured to fill the gap typically formed when installing conventional wall padding, yet may allow for minimal additional weight.

For example, the water permeable member may comprise a plurality of discrete beads of substantially elastic, resilient material wherein portions of adjacent beads abut one another and other portions of the adjacent beads are spaced from each other to create interstitial spaces therebetween and wherein substantially all of the adjacent beads are integrally joined together at the abutting portions thereof.

In one embodiment, the water permeable member may be a porous expanded, beaded polyethylene (EPE) foam which forms a durable yet permeable, lightweight material-offering both drainage and energy absorption. The combination of the water permeable member and the water permeable lower cover allows for water evacuation both vertically and laterally, and wicking of water away from the bottom of the padded member. Thus, the life of the outdoor wall padding apparatus of the present disclosure may reduce the likelihood of mildew, fungus growth, and/or rotting, and extend the life of the outdoor wall padding apparatus. The water permeable member being resilient may act as a padding material and also increase safety to athletes. Also, by integrating the drainage system into the outdoor wall padding apparatus, the outdoor wall padding apparatus may have a unitary or one-piece design so that no separate installation is necessary, and the outdoor wall padding apparatus may be easily installed as a single unit.

In addition, U.S. Pat. No. 7,244,477 issued to Sawyer et al. and assigned to Brock USA, LLC of Boulder, Colo., the entire subject matter of which is hereby incorporated herein by reference, discloses a suitable water draining layer for use in the lower drainage section for the outdoor wall padding apparatus of the present disclosure. For example, such a lower drainage section may be made of a plurality of discrete beads of substantially elastic, resilient material that can be deformed wherein the beads will rebound to their original shapes. The beads may be distributed substantially uniformly throughout the entire lower drainage section. The elastic, resilient beads may be made of materials such as polyethylene or polypropylene. The beads may have substantially spherical shapes wherein portions of adjacent beads abut one another and other portions are spaced from each other. Additionally, substantially all of the adjacent beads are preferably integrally joined (e.g., glued, fused) together at the abutting portions thereof.

The diameters of the beads can vary as desired (e.g., 1/12 to 1/8 inch or more) but preferably are substantially the same (e.g., 1/8 inch). However, the beads can be a mix of diameter sizes (1/12 to 1/4 inches or more). The beads are preferably made of closed cell foam (e.g., polyethylene, or polypropylene) and are waterproof (i.e., non-absorbent). The interstitial spaces between the adjacent beads are in fluid communication with each other and are substantially uniformly spaced or distributed throughout the drainage layer.

Such a water permeable member is very porous and breathable to allow liquids and air to pass freely through the lower support. In addition to being elastic and resilient, the water permeable member offers excellent water drainage. The porosity of such a water permeable member is such that water flows almost without restriction through the water permeable member via the interstitial spaces between adjacent beads and may pass on the order of 300 inches of water per hour. Because the water permeable member is breathable due to the interstitial spaces between the beads being in fluid communication with each other, the water permeable member aids in drying out once the water flow has diminished or ended. In this regard, the air flowing through the spaces will assist in evaporating or dissipating any residual water or moisture.

The density of the water permeable member (including the foam beads and the bonding agent (e.g., polyurethane) joining the abutting portions of the beads) can vary as desired but preferably is in the range of about 5 pounds per cubic foot to about 10 pounds per cubic foot and desirably about 7 pounds per cubic foot. The foam is preferably closed cell so as to be waterproof (i.e., non-absorbent). The beads themselves can be about 70 percent to about 90 percent air and preferably about 80 percent to about 90 percent. Around these general ranges and depending upon the material makeup of the beads, the hardness and resiliency of the water permeable member can thus be varied as desired but without detracting from the operation of the water permeable member including its ability to absorb and dissipate forces, as well as enhance water drainage management. The beads as discussed above are preferably made of elastic, resilient material such as polyethylene or polypropylene but could be made of inelastic, crushable materials such as polystyrene that are essentially incompressible in normal use. The lower support could additionally be a mix or blend of beads of these materials if desired as well as beads of different diameters and of whole and truncated shapes.

With reference again to FIG. 5, a plurality of Z-shaped clips 50 may be attached to and extend horizontally across rear side 44 of backing 40. The Z-shaped clips may be attached to the backing with T-nuts and suitable hardware. The Z-shaped clips include a lower downwardly-depending portion 52 which is spaced from or offset from the backing. The Z-shaped clips allow for a fast and easy method for hanging of the apparatus. For example, corresponding horizontally disposed Z-shaped clips having an upwardly-extending portion may be attached to a vertical structure such as an outdoor fence or wall of a field or stadium with the upwardly-extending portion being spaced from or offset from the fence or wall. Thus, the corresponding Z-shaped clips wedge together to lock the wall padding apparatus in place. To disengage the wall padding apparatus, one simply lifts the wall padding apparatus upward and away from the fence or wall. The Z-clips may be made of aluminum, a plastic material, other metal material, or from other suitable materials. It will be appreciated by those skilled in the art that other suitable means may be employed for attaching the apparatus to a fence or wall.

As shown in FIGS. 1 and 2, the vertical sides of the apparatus are typically disposed adjacent to another outdoor wall padding apparatus when installed, for example, in a stadium. The outdoor wall padding apparatus may be about 4 inches thick, about 4 feet wide, and between about 2 feet and about 10 feet high. It will be appreciated that other sizes may be suitably configured. The height of the lower drainage section between the upper surface and the bottom surface of the lower drainage section may be greater than about 1, about 2 inches, greater than about 2 inches, about 3 inches, greater than about 3 inches, about 4 inches, greater than about 4 inches, about 5 inches, greater than about 5 inches, or other suitable sizes. The bottom of the lower drainage section may be supported by the upper padded section above the ground, or resting on the ground. The bottom of the lower drainage section may be supported on the ground, about ¼ inch, about ½ inch, about ¾ inch, about 1 inch, about 1½ inches, or about 2 inches from the ground.

Figure 7:
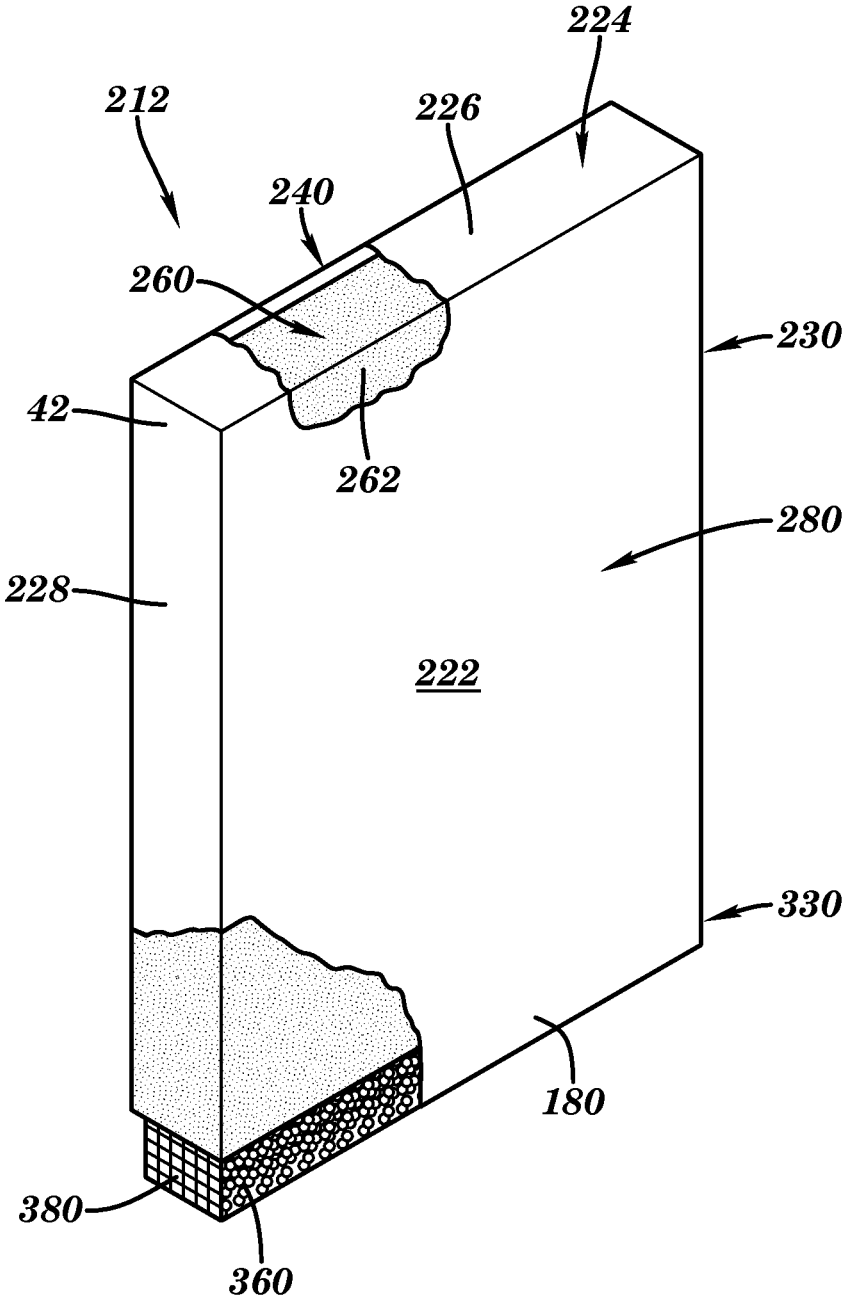
FIG. 7 is a perspective view, partially cutaway, of another embodiment of an outdoor wall padding apparatus having integrated drainage in accordance with aspects of the present disclosure.
Figure 8:
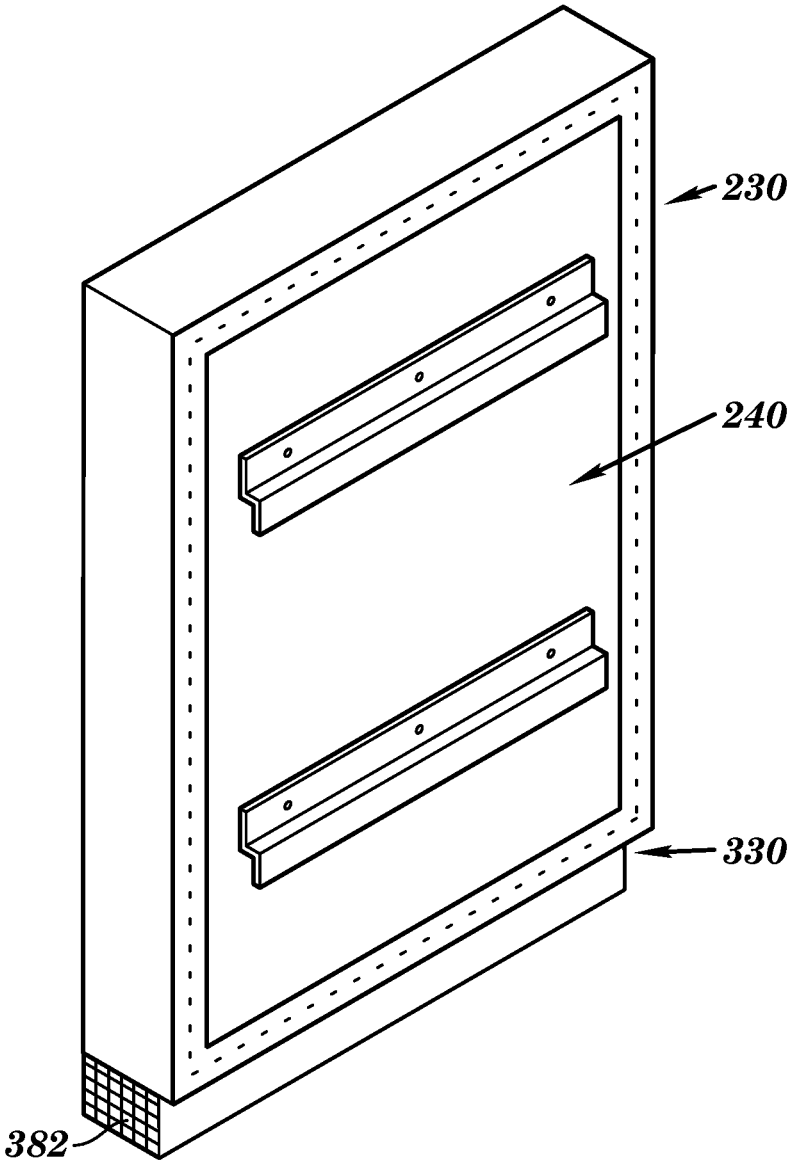
FIG. 8 is a rear perspective view of the outdoor wall padding apparatus having integrated drainage of FIG. 7.

FIGS. 7 and 8 illustrate another embodiment of an exemplary outdoor wall padding apparatus 212 having integrated drainage in accordance with aspects of the present disclosure. A plurality of outdoor wall padding apparatus 212 may be disposed side-by-side along at least a portions of a field or a stadium. Outdoor wall padding apparatus 212 may be essentially the same an outdoor wall padding apparatus 12 described above with the exceptions generally to the cover as described below.

In this illustrated embodiment as shown in FIG. 7, outdoor wall padding apparatus 212 may generally include a main front surface or side 222, a main rear surface or side (not shown in FIG. 7), and a peripherally-extending surface or side 224 disposed between front side 222 and the main rear side. Peripherally-extending side 224 may include a horizontal top side 226, a horizontal bottom side (not shown in FIG. 7), a vertical right side 228, and a vertical left side (not shown in FIG. 7). Outdoor wall padding apparatus 212 may further include an upper padding section 230 and a lower drainage section 330. Upper padding section 230 of outdoor wall padding apparatus 212 may generally include a generally rigid backing 240, a padded member 260, and a cover 280. Lower drainage section 330 of outdoor wall padding apparatus 212 may include a water permeable member 360, a portion of cover 280, and a first porous cover 380 and a second porous cover 382 (FIG. 8).

Cover 280 may cover and extend over a front side 262 and around portions of the thickness of padded member 260, i.e., extend along portions of the peripherally-extending edge of padded member 260, as well as around the front, the back, and the bottom of water permeable member 360. For example, cover 280 may include a central cover portion extending over front side 262 of padded member 260 and a peripherally-extending cover portion defining a horizontal top portion, a vertical right side portion, a vertical left side portion (not shown in FIG. 7) disposed over peripherally-extending a horizontal top edge, a vertical left side edge, and a vertical right side edge, respectively, of the padded member and secured to the rear surface of backing 240 with galvanized or stainless steel staples, nails, or other suitable attachment means as shown in FIG. 8. In addition, cover 280 may extend along the front of water permeable member 360 (FIG. 7), wrap along the bottom of water permeable member 360 (not shown in FIGS. 7 and 8), extend along the back of water permeable member 360, and be secured to the rear surface of backing 240 with galvanized or stainless steel staples, nails, or other suitable attachment means.

With reference again to FIGS. 7 and 8, first porous cover 380 (FIG. 7) and second porous cover 382 (FIG. 8) may cover the ends of elongated water permeable member 360 (FIG. 7). For example, porous covers 380 and 382 may be formed from a vinyl mesh material. It will be appreciated that other suitable porous materials and non-porous materials may be suitably employed for the cover materials. Abutting edge portions of upper cover 280 and first and second covers 380 and 382 may be attached together with, e.g., double stitched seams, or other suitable attachment means. The first and second covers for the lower drainage section of outdoor wall padding apparatus 212 may be sufficient for allowing air and water to penetrate and recede.

In other embodiments in accordance with aspects of the present disclosure, the cover, for example for the upper padded section, may be a resilient cover fabricated from a material or fabric which is stretchable (e.g., having a greater than 50-percent stretch, and desirably greater than 100-percent) in 4 directions and/or in 360-degrees. Desirably the material is able to retain its shape and return back to its original structure after being stretched. The material may also include a high UV protection as well as TEFLON coating for water resistance. When pre-tensioning the resilient cover, the resilient cover may be stretched about or greater than 10-percent, 20-percent, 40-percent, or greater over its normal unstretched size. One suitable stretchable material is sold under the trademark ALLSPORT 4-Way Stretch Vinyl manufactured and available from Morbern, Inc. of Cornwall, Ontario, Canada. For example, the ALLSPORT material has a nominal total thickness of 0.040±0.005 inches (45±5 mils), a standard weight of 32.25±1.5 ounces per linear yard, and greater than 100-percent stretch in both directions. LYCRA and SPANDURA, and combinations with other materials, may also be configured to stretch in 4 directions. It will also be appreciated by those skilled in the art that any other suitable material having 4-way expansion/contraction capabilities may be employed in forming the resilient cover.

Figure 9:
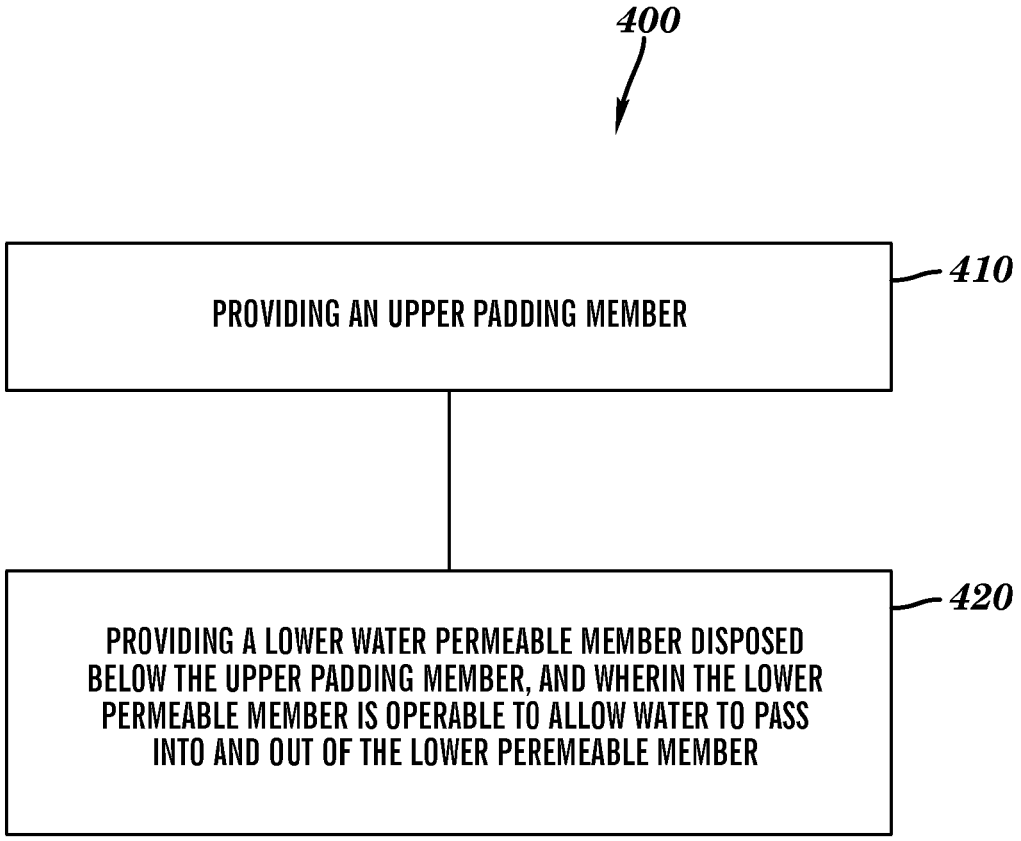
FIG. 9 is a flowchart of a method for forming an outdoor wall padding apparatus having integrated drainage in accordance with aspects of the present disclosure.

FIG. 9 illustrates a flowchart of a method 400 for forming an outdoor wall padding apparatus having integrated drainage in accordance with aspects of the present disclosure. For example, method 400 includes at 410, providing an upper padding member, and at 420, providing a lower water permeable member disposed below the upper padding member wherein the lower permeable member is operable to allow water to pass into and out of the lower permeable member.

Figure 10:
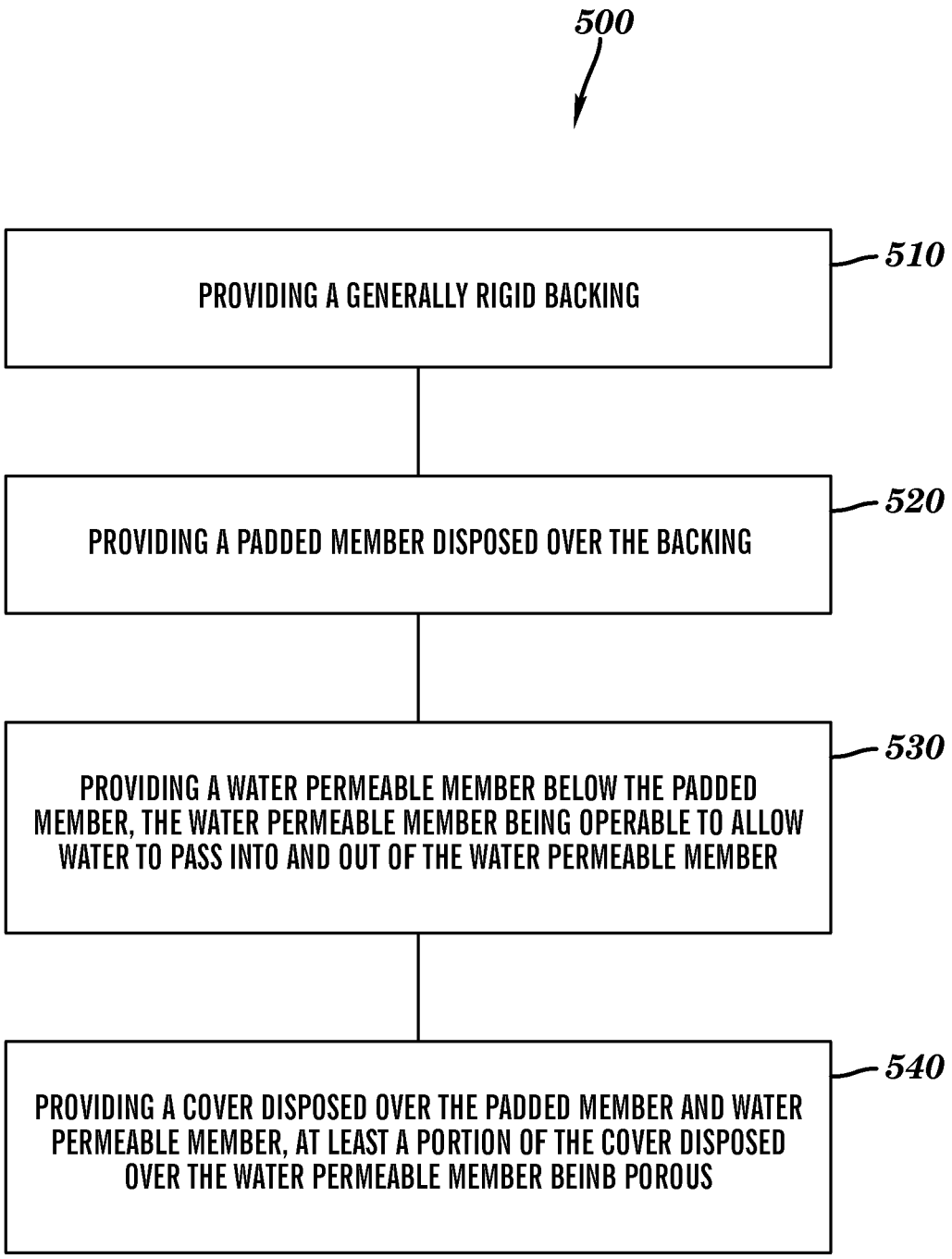
FIG. 10 is a flowchart of another method for forming an outdoor wall padding apparatus having integrated drainage in accordance with aspects of the present disclosure.

FIG. 10 illustrates a flowchart of a method 500 for forming an outdoor wall padding apparatus having integrated drainage in accordance with aspects of the present disclosure. Method 500 may include at 510, providing a generally rigid backing, at 520, providing a padded member disposed over the backing, at 530, providing a water permeable member below the padded member in which the water permeable member is operable to allow water to pass into and out of the water permeable member, and at 540, providing a cover disposed over the padded member and water permeable member with at least a portion of the cover disposed over the water permeable member being porous.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. An outdoor wall padding apparatus attachable to a vertical structure facing a playing field, said outdoor wall padding apparatus comprising:

an upper padding section comprising:

a generally rigid backing having a front surface and a bottom surface;

a padded member disposed over said front surface of said generally rigid backing, said padded member having a front surface and a bottom surface;

a first cover extending over said front surface of said padded member;

at least one connector attached to the rigid backing;

a lower section disposed below said upper padding section, said lower section comprising:

a member having an upper surface, a front surface, a bottom surface, and a rear surface, said upper surface of said lower section disposed below said bottom surface of said padded member, and said member disposed below said bottom surface of said generally rigid member, said member comprising a material different from said upper padding section;

a second cover extending over said front surface, said bottom surface, and said rear surface of said member, said second cover operably attached to said generally rigid backing above a lower surface of said padded member, said second cover different from said first cover;

a front surface of said upper padding section and a front surface of said lower section defining a generally planar front surface;

said lower section being sized and configured to fill a gap between the ground and said bottom surface of said padded member when said outdoor wall padding apparatus is attached via said at least one connector to the vertical structure and said lower section is suspended from said upper section to maintain a sports ball on the playing field and inhibit the sports ball from passing behind said generally planar front surface of said outdoor wall padding apparatus; and said lower section operable to extend the life of said outdoor wall padding apparatus compared to said upper padding section being disposed on the surface of the ground.

2. The outdoor wall padding apparatus of claim 1 wherein said lower section is substantially supportable by the upper padding section above the ground.

3. The outdoor wall padding apparatus of claim 1 wherein said member comprises a water permeable member and said second cover comprises a porous cover.

4. The outdoor wall padding apparatus of claim 1 wherein said first cover of said upper padding section comprises a non-water permeable cover and said second cover of said lower section comprises a water permeable cover.

5. The outdoor wall padding apparatus of claim 1 wherein said first cover of said upper padding section comprises a non-water permeable cover.

6. The outdoor wall padding apparatus of claim 1 wherein said first cover of said upper padding section comprises a vinyl material, and said second cover of said lower section comprises a mesh fabric.

7. The outdoor wall padding apparatus of claim 1 wherein a lower portion of said first cover of said upper padding section is sewn to an upper portion of said second cover of said lower section.

8. The outdoor wall padding apparatus of claim 1 wherein said upper padding section comprises a non-water permeable cover.

9. The outdoor wall padding apparatus of claim 1 wherein said upper padding section is attached to said lower drainage section to form a unitary outdoor wall padding apparatus.

10. The outdoor wall padding apparatus of claim 1 wherein said lower section comprises a plurality of discrete beads of substantially elastic, resilient material wherein portions of adjacent beads abut one another and other portions of said adjacent beads are spaced from each other to create interstitial spaces therebetween and wherein substantially all of said adjacent beads are integrally joined together at the abutting portions thereof.

11. The outdoor wall padding apparatus of claim 10 wherein said interstitial spaces allow fluid communication across the lower section.

12. The outdoor wall padding apparatus of claim 10 wherein said beads comprise at least one of polypropylene and polyethylene.

13. The outdoor wall padding apparatus of claim 1 wherein said lower section comprises a height of about 4 inches.

14. The outdoor wall padding apparatus of claim 1 wherein said outdoor wall padding apparatus comprises a thickness of about 4 inches, a width of about 4 feet, and a height between about 2 feet and about 10 feet.

15. An outdoor wall padding system comprising:

a plurality of outdoor wall padding apparatus of claim 1 operably attached to the vertical structure disposed around at least a portion of a field.

16. A method for use in protecting athletes on an outdoor field, the method comprising:

providing a plurality of outdoor wall padding apparatus of claim 1 disposed side-by-side around at least a portion of the outdoor field.

17. The method of claim 16 further comprising allowing water to pass into and out of the lower section.

18. A method for use in protecting athletes on an outdoor field, the method comprising:

providing a plurality of outdoor wall padding apparatus of claim 4 disposed side-by-side around the outdoor field.

19. The method of claim 18 further comprising allowing water to pass into and out of the lower section.

20. A method for use in maintaining a sports ball on a field, the method comprising:

providing a plurality of outdoor wall padding apparatus of claim 1;

supporting the plurality of outdoor wall padding apparatus from a wall side-by-side along at least a portion of the field; and suspending the lower sections from the upper padding sections adjacent to the ground so that the sports ball is prevented from passing underneath the upper padding sections of the plurality of outdoor wall padding apparatus.

21. The method of claim 20 further comprising allowing water to pass into and out of the lower section.

22. A method for use in maintaining a sports ball on a playing field, the method comprising:

providing a plurality of outdoor wall padding apparatus of claim 4;

supporting the plurality of outdoor wall padding apparatus from a wall side-by-side along at least a portion of the field; and suspending the lower sections from the upper padding sections adjacent to the ground so that the sports ball is prevented from passing underneath the lower drainage section upper padding sections of the plurality of outdoor wall padding apparatus.

23. The method of claim 22 further comprising allowing water to pass into and out of the lower section.

* * * * *